US005879874A

United States Patent [19]

Maskasky et al.

[11] Patent Number: 5,879,874

[45] Date of Patent: Mar. 9, 1999

[54] PROCESS OF PREPARING HIGH CHLORIDE {100} TABULAR GRAIN EMULSIONS

[75] Inventors: Joe E. Maskasky; Victor P. Scaccia, both of Rochester; Samuel Chen, Penfield, all of N.Y.

[73] Assignee: Eastman Kodak Company, Rochester, N.Y.

[21] Appl. No.: 961,962

[22] Filed: Oct. 31, 1997

[51] Int. Cl.[6] ..... G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,806,461 | 2/1989 | Ikeda et al. | 430/567 |
| 5,068,173 | 11/1991 | Takehara et al. | 430/567 |
| 5,275,930 | 1/1994 | Maskasky | 430/567 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,413,904 | 5/1995 | Chang et al. | 430/569 |
| 5,418,124 | 5/1995 | Suga et al. | 430/567 |
| 5,472,836 | 12/1995 | Haga | 430/567 |
| 5,525,460 | 6/1996 | Maruyama et al. | 430/567 |
| 5,527,664 | 6/1996 | Kikuchi et al. | 430/569 |
| 5,550,012 | 8/1996 | Suga | 430/567 |
| 5,550,014 | 8/1996 | Maruyama et al. | 430/567 |
| 5,663,041 | 9/1997 | Chang et al. | 430/569 |
| 5,665,530 | 9/1997 | Oyamada et al. | 430/567 |
| 5,672,467 | 9/1997 | Buitano et al. | 430/363 |
| 5,707,793 | 1/1998 | Oyamada | 430/567 |

FOREIGN PATENT DOCUMENTS 0 670 515 A2 9/1995 European Pat. Off. .

OTHER PUBLICATIONS

G.C. Farnell, R.B. Flint & J.B. Chanter, "Preferred Sites for Latent–Image Formation", *J. Photogr. Sci.,* 13:25(1965).

J.F. Hamilton, Electron–Microscope Study of Defect Structure and Photolysis in Silver Bromide Microcrystals:, *Photogr. Sci. Eng.,* 11:57(1967).

G.C. Farnell, R.L. Jenkins & L.R. Solman, Grain Disorder and its Influence on Emulsion Response:, *J. Photogr. Sci.,* 24:1(1976).

*Primary Examiner*—Mark F. Huff
*Attorney, Agent, or Firm*—Carl O. Thomas

[57] ABSTRACT

A process is disclosed for preparing high chloride {100} tabular grain emulsions containing crystal lattice dislocations in peripheral regions of the tabular grains. In the initial step of the process a radiation-sensitive high chloride {100} tabular grain emulsion is produced to provide host grains. Lateral growth lateral growth of the {100} major surfaces of the tabular grains is extended by precipitating a high chloride peripheral region onto the host tabular grains. After the host grains have been provided an iodide ion source compound with a maximum second order reaction rate constant within the dispersing medium of less than $1\times10^3$ mole$^{-1}$ sec$^{-1}$ is introduced into the host emulsion to release iodide ions for incorporation into the tabular grains at their peripheral edges by chloride ion displacement. In the resulting emulsion 10 or more crystal lattice dislocations extending inwardly from the peripheral edges of the {100} tabular grains are observed. The dislocations in the peripheral and, particularly, corner regions of the tabular grains increase their sensitivity.

11 Claims, 2 Drawing Sheets

PROCESS OF PREPARING HIGH CHLORIDE {100} TABULAR GRAIN EMULSIONS

FIELD OF THE INVENTION

The invention relates to a process for preparing radiation-sensitive silver halide emulsions useful in photographic and radiographic imaging.

DEFINITION OF TERMS

In referring to grains and emulsions containing two or more halides, the halides are named in order of ascending concentrations.

The term "high chloride" or "high bromide" in referring to grains and emulsions indicates that chloride or bromide, respectively, is present in a concentration of greater than 50 mole percent, based on total silver.

The term "equivalent circular diameter" or "ECD" is employed to indicate the diameter of a circle having the same projected area as a silver halide grain.

The term "equivalent circular radius" or "ECR" is employed to indicate the radius of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{100} tabular" or "{111} tabular" is employed in referring to tabular grains and tabular grain emulsions to indicate tabular grains having major faces lying in {100} or {111} crystal planes, respectively.

The term "dislocation" refers to a crystal lattice defect that can be observed by microscopic examination of a tabular grain major face.

The term "peripheral region" in referring to a tabular grain indicates that portion of the grain between its major faces extending inwardly from the peripheral edges of the major faces by a distance amounting to 10 percent of the ECR of the tabular grain.

The term "corner region" indicates that portion of the peripheral region that lies in the vicinity of the corner of a {100} tabular grain as viewed perpendicular to one major face.

A better visualization of the peripheral and corner regions as well as the quantification of their limits can be appreciated by reference to FIG. 2, wherein a {100} tabular grain T is shown as viewed perpendicular to one major face. The grain has a peripheral boundary E. The peripheral boundary is in part linear and in part curved in the vicinity of the grain corners. Linear extrapolations of the linear portions of the peripheral boundary X1, X2, X3 and X4 intersect at points C1, C2, C3 and C4. Diagonal D1 extends between points C1 and C3. Diagonal D2 extends between points C2 and C4. The diagonals intersect at point A, which is the center of both the {100} major face of the tabular grain and the center of a circle C having an area equal to the projected area of the grain within the peripheral boundary. ECR extending between A and C is the equivalent circular radius of the grain. The peripheral region PR extends between the outer edge E of the grain and boundary B spaced inwardly from E by a distance amounting to 10 percent of ECR. The portion of the grain lying within the boundary B is the central region of the grain. The corner regions CR1, CR2, CR3 and CR4 are those four portions of the peripheral region that each lie within the peripheral region within an arc F swung from the intersection of E with a diagonal, the arc having a radius R that is 25 percent of the distance between adjacent intersection points (e.g., between C1 and C4 or C1 and C2). When the distance between C1 and C4 differs from the distance between C1 and C2, the two are averaged in arriving at R. As shown all of the grains are equally rounded in the vicinity of each corner. However, the definition above applies equally when the grains are unequally rounded in the vicinity of their corners.

The term "vAg" indicates the potential difference in volts between a standard reference electrode (Ag/AgCl with 4 molar KCl at room temperature) in a 4 molar KCl salt bridge and an anodized Ag/AgCl indicator electrode.

*Research Disclosure* is published by Kenneth Mason Publications, Ltd., Dudley House, 12 North St., Emsworth, Hampshire P010 7DQ, England.

BACKGROUND

Marked improvements in the performance of photographic emulsions began in the 1980's, resulting from the introduction of tabular grain emulsions into photographic products. A wide range of photographic advantages have been provided by tabular grain emulsions, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multi-emulsion layer formats.

Although tabular grain emulsions can be selected to provide a variety of performance advantages, depending upon the photographic application to be served, initially commercial interest focused on achieving the highest attainable photographic speeds with minimal attendant granularity. This capability of high bromide {111} tabular grain emulsions was demonstrated by Wilgus et al U.S. Pat. No. 4,434,226 and Kofron et al U.S. Pat. No. 4,439,520. It was, of course, recognized that minor amounts of iodide further improve the speed-granularity relationship, and Solberg et al U.S. Pat. No. 4,433,048 taught that increased iodide concentrations near the peripheral edge of the tabular grains further improved the speed-granularity relationship.

Sometime after silver iodobromide {111} tabular grain emulsions appeared in photographic film products Ikeda et al U.S. Pat. No. 4,806,461 microscopically examined high bromide {111} tabular grains and concluded their superior speed-granularity could be attributed in part to the presence of 10 or more dislocations in tabular grains accounting for at least 50 percent of total grain projected area. This observation was reiterated by Takehara et al U.S. Pat. No. 5,068,173, Haga et al U.S. Pat. No. 5,472,836, Suga et al U.S. Pat. No. 5,550,012, and Maruyama et al U.S. Pat. No. 5,550,014. Before tabular grain emulsions were commercially used and before the observations of Ikeda et al, dislocations had been observed in high bromide {111} tabular grains and postulated to facilitate latent image formation, as illustrated by G. C. Farnell, R. B. Flint and J. B. Chanter, "Preferred Sites for Latent-Image Formation", *J. Photogr. Sci.,* 13:25(1965); J. F. Hamilton, "Electron-Microscope Study of Defect Structure and Photolysis in Silver Bromide Microcrystals", *Photogr. Sci. Eng.,* 11:57

(1967); and G. C. Farnell, R. L. Jenkins and L. R. Solman, "Grain Disorder and its Influence on Emulsion Response", *J. Photogr. Sci.,* 24:1(1976).

Black et al U.S. Pat. No. 5,709,988 discovered that the crystal lattice dislocations in the central region of high bromide {111} tabular grains increase pressure sensitivity while the crystal lattice dislocations in the peripheral region of the tabular grains increase sensitivity without increasing pressure sensitivity.

The first high chloride tabular grain emulsions contained {111} tabular grains, as illustrated by Wey U.S. Pat. No. 4,399,215 and Maskasky U.S. Pat. No. 4,400,463. Maskasky U.S. Pat. Nos. 5,292,632 and 5,275,930 overcame the problem of high chloride {111} tabular grain morphological instability by providing the first high chloride {100} tabular grain emulsions. The combination of the known ecological and developability advantages of high chloride emulsions with the higher tabular shape stability of high chloride grains with {100} crystal faces has stimulated interest in high chloride {100} tabular grain emulsions.

Several forms of incorporation of iodide into high chloride {100} tabular grains have been investigated. House et al U.S. Pat. No. 5,320,938, Chang et al U.S. Pat. No. 5,413,904, and Saito EPO 0 670 515 realized advantages to be obtained when iodide is added at or near grain nucleation.

Brust et al U.S. Pat. No. 5,314,798 observed a speed increase without an offsetting granularity increase when a band of higher iodide content is grown onto a high chloride {100} tabular grain. Potassium iodide is the demonstrated source of iodide during band formation. Chang et al U.S. Pat. No. 5,663,041 is cumulative with Brust et al.

The use of organic iodide compounds during the precipitation of silver halide grains is illustrated by Suga et al U.S. Pat. No. 5,418,124, Maruyama et al U.S. Pat. No. 5,525,460, and Kikuchi et al U.S. Pat. No. 5,527,664.

RELATED APPLICATION

Maskasky, Scaccia and Chen U.S. Ser. No. 08/955,867, filed Oct. 21, 1997, titled HIGH CHLORIDE TABULAR GRAIN EMULSIONS AND PROCESSES FOR THEIR PREPARATION, commonly assigned, now allowed, discloses a process of preparing high chloride {100} tabular grain emulsions wherein greater than 10 percent of the tabular grains contain 10 or more crystal lattice dislocations extending inwardly from their peripheral edges. The crystal lattice dislocations are created by introducing iodine into a host grain emulsion, converting the iodine to iodide, and incorporating into the peripheral edges of the tabular host grains as further growth occurs.

SUMMARY OF THE INVENTION

This invention provides a process for the preparation of high chloride {100} tabular grain emulsions exhibiting increased sensitivity. It has been discovered quite unexpectedly that the introduction of an organic compound that releases iodide at a slow rate during growth forming a peripheral region of the {100} tabular grains creates a high proportion of crystal lattice dislocations extending inwardly from the peripheral edges of the high chloride {100} tabular grains.

The dislocation pattern, though observed previously in high bromide {111} tabular grain emulsions, has not been achieved prior to this invention in high chloride {100} tabular grain emulsions. When conventional approaches for iodide incorporation into the peripheral region of high chloride {100} tabular grains have been employed—those that provide iodide ions, either as soluble iodide salts or by releasing iodide ions from silver iodide grains by Ostwald ripening, a comparable dislocation pattern is not produced.

In one aspect, this invention is directed to a process of preparing a tabular grain emulsion comprised of the steps of (1)

providing an emulsion comprised of a dispersing medium and radiation-sensitive silver halide host grains in which (i) the radiation-sensitive silver halide host grains contain greater than 50 mole percent chloride, based on silver, and (ii) greater than 50 percent of host grain projected area is accounted for by tabular grains having parallel {100} major faces, and (2) extending lateral growth of the {100} major surfaces of the tabular grains by precipitating additional silver halide containing greater than 50 percent chloride, based on silver, to form tabular grains with {100} major faces extending to peripheral edges of the tabular grains, wherein, following step (1), an iodide ion source compound with a maximum second order reaction rate constant within the dispersing medium of less than $1\times10^3$ mole$^{-1}$ sec$^{-1}$ is introduced into the dispersing medium to release iodide ions for incorporation into the tabular grains at their peripheral edges by chloride ion displacement, to create 10 or more crystal lattice dislocations extending inwardly from the peripheral edges of greater than 10 percent of the tabular grains having {100} major faces.

DESCRIPTION OF PREFERRED EMBODIMENTS

Figure 1:
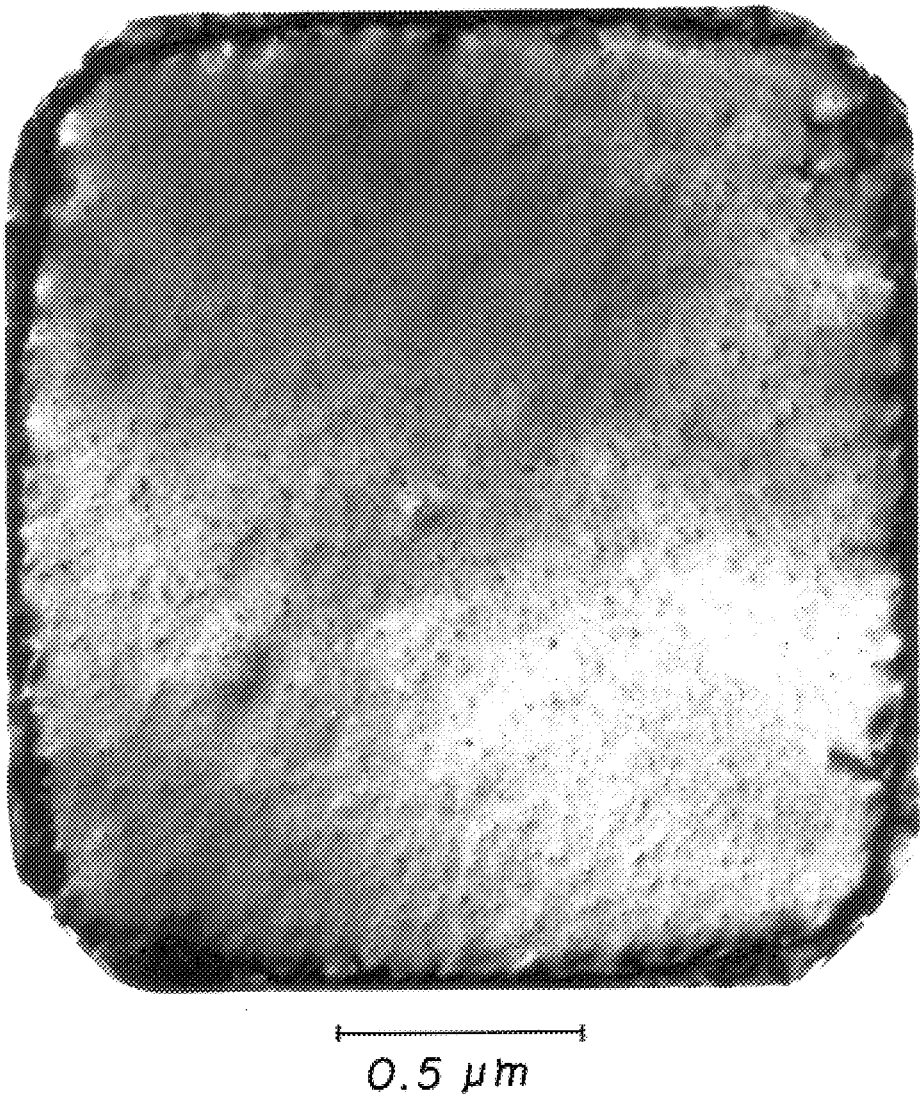
FIG. 1 is a transmission electron micrograph of a representative high chloride {100} tabular grain having peripheral edge dislocations prepared by the process of this invention.
Figure 2:
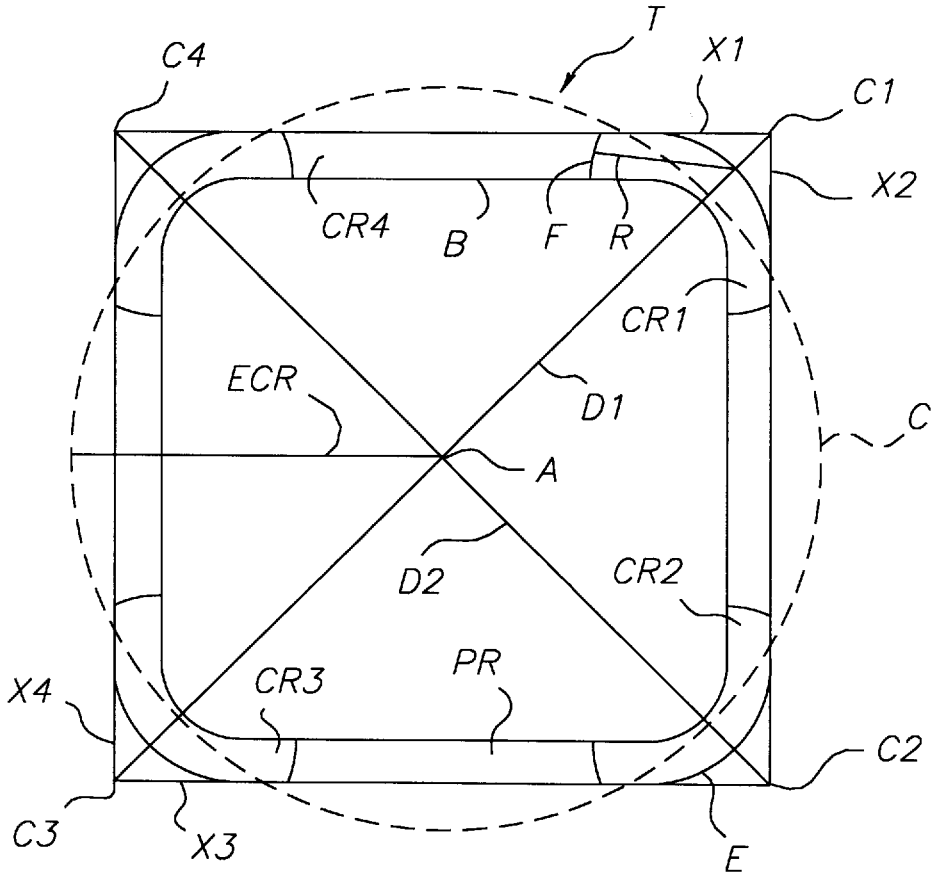
FIG. 2 depicts a high chloride {100} tabular grain viewed perpendicular to one major face.

The process of the invention begins by starting with and then modifying during further growth any conventional high chloride {100} tabular grain emulsion. Examples of starting emulsions and their preparation are provided by the following patents (hereinafter referred to as the starting emulsion patents), the disclosures of which are here incorporated by reference:

| | |
|---|---|
| Maskasky | U.S. patent 5,292,632; |
| House et al | U.S. patent 5,320,938; |
| Saitou et al | U.S. patent 5,652,089; |
| Maskasky | U.S. patent 5,264,337; |
| Brennecke | U.S. patent 5,498,518; |
| Chang et al | U.S. patent 5,413,904; |
| Brust et al | U.S. patent 5,314,798; |
| Olm et al | U.S. patent 5,457,021; |
| Oyamada | U.S. patent 5,593,821; |
| Oikawa | U.S. patent 5,654,133; |
| Saitou et al | U.S. patent 5,587,281; |
| Yamashita | U.S. patent 5,565,315; |
| Yamashita et al | U.S. patent 5,641,620; |
| Yamashita et al | U.S. patent 5,652,088; and |
| Chang et al | U.S. patent 5,633,041. |

By definition the starting high chloride {100} tabular grain emulsions (i) contain greater than 50 mole percent chloride, based on silver and (ii) have greater than 50 percent of total grain projected area accounted for by tabular grains having an aspect ratio of at least 2.

The starting emulsions preferably contain greater than 70 mole percent chloride, based on silver, and optimally greater than 90 mole percent chloride, based on silver. The remaining halide, if any, can be bromide and/or iodide. It is preferred to limit iodide concentrations to less than 10 (most preferably less than 5) mole percent, based on silver. When iodide is employed at or near grain nucleation solely for inducing tabular grain growth, amounts of iodide as low as 0.001 (preferably 0.01) mole percent iodide have been shown to be sufficient to provide {100} tabular grains. Contemplated silver grain compositions include silver chloride, silver iodochloride, silver bromochloride, silver iodobromochloride and silver bromoiodochloride.

The tabular grains preferably account at least 70 percent of total grain projected area and optimally at least 90 percent of total grain projected area. The tabular grains preferably have an average aspect ratio of at least 5 and most preferably greater than 8. The tabular grains preferably have an average thickness of less than 0.3 $\mu$m and most preferably less than 0.2 $\mu$m. Ultrathin tabular grain emulsions, those in which the tabular grains have an average thickness of less than 0.07 $\mu$m, are specifically contemplated.

It is generally preferred to choose starting high chloride {100} tabular grain emulsions having the highest conveniently realized proportion of the total high chloride grain population accounted for by {100} tabular grains while also having the lowest conveniently realized average thickness of the tabular grains.

The average aspect ratio of the {100} tabular grains is limited by the average grain ECD desired in the emulsion prepared from the starting emulsion. With minimum amounts of silver addition in the process of the invention the starting emulsion can have a mean grain ECD that is not significantly different from that of the product emulsion. The maximum increase in mean grain ECD in the product emulsion occurs when a maximum amount of silver is introduced in the growth step of the invention and all or substantially all of the growth occurs at the edges of tabular grains. In the case of tabular grains the percent increase in average grain projected area (PA) is the same as the percent additional silver added. Using the formula:

$$PA=\pi(ECR)^2 \quad (I)$$

the degree to which the mean grain ECD (ECR×2) in the starting emulsion must be reduced below the desired mean grain ECD in the product emulsion can be calculated.

The first step, step (1), of the process of the invention is to provide a high chloride {100} tabular grain emulsion as described above. The second step, step (2), is to continue growth onto the peripheral edges of the {100} tabular grains while introducing crystal lattice dislocations. Subsequent to step (1), three successive steps occur: In step (a) an iodide ion source compound is introduced into the dispersing medium. In step (b) the iodide ion is released from the source compound, and in step (c) the iodide is incorporated into the tabular grains at their peripheral edges by displacement of chloride ions.

Step (a) begins with the starting high chloride {100} tabular grain emulsion in a reaction vessel. This can be the reaction vessel in which the starting emulsion of step (1) has been grown and in which the further tabular grain growth of step (2) also occurs. Before proceeding to step (2), the iodide ion source compound is introduced into and dissolved in the dispersing medium.

Iodide ion source compound can be introduced in any amount sufficient to introduce the desired concentration of crystal lattice dislocations. Generally iodide ion source compound addition is chosen to provide iodide ion in a concentration of at least 0.1 (preferably 0.2) mole percent, based on silver introduced in step (1). There is no necessity for increasing iodide ion concentrations above 5 mole percent, based on step (1) silver addition, in order to achieve a sensitizing concentration of peripheral crystal lattice dislocations. It is, in fact, preferred to limit iodide ion addition to 4 mole percent or less, based on step (1) silver addition. The purpose in limiting iodide ion source compound addition is to avoid achieving such a high level of crystal lattice dislocations that the tabular character of the grains is put at risk. However, it must be borne in mind that the iodide ion source compound additions result in lower peak iodide levels than suggested by the percentages indicated above, since the iodide in the grains resulting from iodide ion source compound addition is in its final placement present in portions of the high chloride {100} grains formed both before and after iodide ion releasing source compound addition.

Instead of introducing iodide ion in the form of an inorganic salt solution, such as an alkali or alkaline earth iodide solution, which is dissociated into component ions prior to introduction into the dispersing medium, the present invention contemplates release of iodide ion into the dispersing medium at a controlled rate. It has been observed quite unexpectedly that, by delaying release of the iodide ion until after an iodide containing compound has been introduced and well distributed within the dispersing medium, the proportion of high chloride {100} tabular grains with 10 more peripheral region crystal lattice dislocations is increased and the grain population of the emulsion is more nearly uniform. For example, so-called "exploded" grains—tabular grains that have wholly or partially disintegrated due to localized excessive iodide concentrations—are entirely obviated.

In the process of the invention the controlled rate of availability of iodide ion results from a reaction between the iodide ion source compound and an iodide ion release controlling compound. In the simplest possible form of the invention the gelatino-peptizer present in the dispersing medium reacts with the iodide ion source compound and serves as the iodide ion release controlling compound.

Any conventional gelatino-peptizer can be employed. Various conventional forms of gelatino-peptizers are illustrated by *Research Disclosure,* Vol. 38957, September 1996, Item 38957, Section II. Vehicles, vehicle extenders, vehicle-like addenda and vehicle related addenda, A. Gelatin and hydrophilic colloid peptizers, particularly paragraphs (1) to (3). As manufactured and employed in photography gelatino-peptizers typically contain significant concentrations of calcium ion, although the use of deionized gelatino-peptizers is a known practice. In the latter instance it is preferred to compensate for calcium ion removal by adding divalent or trivalent metal ions, such alkaline earth or earth metal ions, preferably magnesium, calcium, barium or aluminum ions.

It is specifically contemplated to employ gelatino-peptizers that contain natural levels of methionine—almost always >50 (and typically >100) micromoles per gram. It is preferred to employ gelatino-peptizer that has been treated with an oxidizing agent to reduce methionine to levels of <30 (preferably <12) micromoles per gram. Oxidized gelatino-peptizers typically contain less than measurable levels of methionine—e.g., <5 micromoles of methionine per gram.

A more extensive discussion of gelatin and its properties is provided by James *The Theory of the Photographic Process,* 4th Ed., Macmillan, New York, 1977, Chapter 2, Gelatin. Any of the varied forms of gelatino-peptizers disclosed by the starting emulsion patents, incorporated by reference above, can be employed.

To increase the rate at which iodide ion is released within the dispersing medium, an iodide ion release controlling compound that reacts more rapidly than the gelatino-peptizer with the iodide ion source compound can be added to the dispersing medium. Iodide ion release controlling compounds can be selected from those disclosed for use by Takada et al U.S. Pat. No. 5,389,508, Suga et al U.S. Pat. No. 5,418,124, Maruyama et al U.S. Pat. No. 5,525,460, and Kikuchi et al U.S. Pat. No. 5,527,664 all here incorporated by reference. The iodide ion release controlling compound can be a base or a nucleophilic compound. When the iodide ion release controlling compound is a base, hydroxide ion is the reactive component. Sulfite is another preferred reactive component. The counter ion for the hydroxide or sulfite ion can take any convenient form known to be compatible with silver halide precipitation processes. For example, alkali, alkaline earth and ammonium counter ions are commonly employed in the precipitation of silver halide emulsions and are specifically contemplated as counter ions in iodide ion release controlling compounds employed in the practice of this invention.

The iodide ion source compound can take the form of an organic iodide:

$$R—I \qquad (II)$$

where R is an organic moiety providing a carbon to iodide bond.

In quantitative terms, the suitability of the R—I organic iodide releasing compound can be explained in terms of its limited maximum second order reaction rate constant in interacting to release iodide ion within the dispersing medium. When gelatino-peptizer is the sole compound within the dispersing medium capable of reacting with the iodide ion source compound, the second order reaction rate constant is less than $1\times10^{-3}$ mole$^{-1}$–sec$^{-1}$, and the gelatino-peptizer functions as an iodide ion release controlling compound. When a compound is added to the dispersing medium that reacts with the iodide ion source compound more rapidly than the gelatino-peptizer, this compound replaces the gelatino-peptizer as the iodide ion release controlling compound. For example, hydroxide ion and sulfite ion additions are each capable of increasing second order reaction rate constant into the range of from $5\times10^{-3}$ to $<1\times10^{3}$ mole$^{-1}$–sec$^{-1}$.

The maximum second order reaction rate constant, is determined by the rate of reaction between the iodide ion source compound and the compound within the dispersing medium that is functioning as the iodide ion release controlling compound (i.e., the compound that reacts most rapidly with the iodide ion source compound to release iodide ion). The maximum second order reaction rate constant is derived from the following relationship:

$$dI^{-}/dt=k[R—I][RCC] \qquad (III)$$

where k is the second order reaction rate constant;

dI/dt is the rate of iodide ion release, expressed in gram-atoms/second;

[R—I] is the molar concentration in moles per liter of R—I, defined above; and

[RCC] is the molar concentration in moles per liter of the iodide ion release controlling compound. When gelatino-peptizer within the dispersing medium is acting as the iodide ion release controlling compound, instead of determining the actual molecular weight of the gelatino-peptizer employed (which is, of course, itself an average), a typical average molecular weight of a photographic gelatino-vehicle of $1\times10^{5}$ daltons can be alternatively employed.

Preferred organic moieties (R) are those that are relatively water soluble. Typically such compounds contain 10 or fewer carbon atoms. Although the iodide substituent can itself promote slight water solubility, at least one additional polar substituent is preferred to promote solubility, particularly when R contains three or more carbon atoms. Examples of suitable iodide ion releasing compounds include the following:

| | |
|---|---|
| IRC-1 | α-Iodoacetic acid |
| IRC-2 | α-Iodoacetamide |
| IRC-3 | Iodomethane |
| IRC-4 | Iodocyanomethane |
| IRC-5 | 1-Acetophenone |
| IRC-6 | 3-Iodopropanoic acid |
| IRC-7 | 4-Iodobutanoic acid |
| IRC-8 | 2-(Iodomethyl)pyridine |
| IRC-9 | Iodomethylbenzene |
| IRC-10 | 1-Iodo-2-hydroxypropane |
| IRC-11 | 2-Iodoethanol |
| IRC-12 | 3-Iodopropanol |
| IRC-13 | 4-Iodobutanol |
| IRC-14 | 1-Hydroxy-1-phenyl-2-iodoethane |
| IRC-15 | 1,2-Dihydroxy-3-iodopropane |
| IRC-16 | 1-Hydroxy-2-iodocyclohexane |
| IRC-17 | 2,3-Dihydroxy-1,4-diiodobutane |
| IRC-18 | 1-Hydroxy-2-iodocyclopentane |
| IRC-19 | α-Iodo-α-phenylacetic acid |
| IRC-20 | α,α-Diiodoacetic acid |
| IRC-21 | Iodosuccinic acid |
| IRC-22 | 2-Hydroxy-1,3,-diiodopropane |
| IRC-23 | 1-Iodomethyl-4- methoxybenzene |
| IRC-24 | 2,4,5-Triiodoimidazole |
| IRC-25 | 1-Iodo-3-oxo-1-cyclohexene |
| IRC-26 | 5-Chloro-2,6-dioxo-1,3-dimethyl-4-iodo-1,3-diazine |
| IRC-27 | 2-Iodo-4-pyrone |
| IRC-28 | 1 Cyano-4-iodo-3-methylsulfobenzene |
| IRC-29 | 1-Iodomethyl-2,5-pyrrolidione |
| IRC-30 | 1-Iodomethyl-2,7-benzopyrrolidione |
| IRC-31 | 1-Iodomethylmorpholine |
| IRC-32 | 1,1-Dicyano-2-iodoethene |
| IRC-33 | ζ-iodohexanoic acid |
| IRC-34 | 1,2-Di(iodomethyl)benzene |
| IRC-35 | 2-Iodomethylphenol |
| IRC-36 | 4-Iodomethylbenzoic acid |
| IRC-37 | 3-Hydroxy-5-iodopentanol |
| IRC-38 | Methyl γ-iodopropanoate |
| IRC-39 | Ethyl α-iodoacetate |
| IRC-40 | 1-Iodomethylpyrazole |

In step (b) free iodide ion is released by the iodide ion releasing compound into the dispersing medium. Step (b) occurs spontaneously, but not instantaneously. It usually takes place over a period of seconds to a few minutes.

Spontaneously, following the release of free iodide ion, step (c) occurs. The iodide ions displace chloride ions from the high chloride {100} tabular grains. The chloride ions at the peripheral edges of the {100} tabular grains are more readily displaced than chloride ions elsewhere within the crystal lattice structure of the {100} tabular grains. Further, the chloride ions at the peripheral edges become progressively easier to displace with iodide ions approaching the corners of the grains. Since iodide ion releasing compound releases iodide ions in a controlled manner, iodide ions are formed at a controlled rate that allows selective displacement of chloride ions at the peripheral edges and, with some care to control iodide ion delivery rates, chloride ion displacement by iodide ion can be guided toward the corners of the {100} tabular grains of the starting emulsion.

When iodide ion displaces chloride ion in the starting {100} tabular grains, chloride ion is released into the dispersing medium. This can be observed as a decline in the vAg of the dispersing medium. As the rate of iodide ion incorporation in the {100} tabular grains nears completion, the rate at which the vAg declines is observed to slow. To allow iodide displacement of chloride ion to go to completion, it is usually preferred to hold the emulsion for a few (typically 2 to 15) minutes following iodide ion releasing compound addition. However, if the iodide ion releasing compound is itself added slowly to the dispersing medium, the iodide ion release followed by iodide displacement of chloride in the grain structure may be very nearly complete before the last of the iodide ion releasing compound reaches the dispersing medium. In this instance, no further hold of the emulsion following termination of iodide ion releasing compound addition is required before proceeding to step (2).

During step (2) silver and the other halide ions can be supplied from soluble salts or can be supplied from smaller grains, such as Lippmann grains, by Ostwald ripening. It is, of course, recognized that higher iodide concentrations than the maximum contemplated iodide concentrations named above in step (a) can be introduced into the grains during step (2) merely by adding iodide ions in any convenient conventional manner. For example, increased levels of iodide in the grains can be used to increase interimage effects and can be used to increase the native blue sensitivity of the grains. However, in most instances the maximum preferred levels of iodide in step (a) addition are adequate to provide all of the iodide desired for imaging purposes at the peripheral edges of the high chloride {100} tabular grains.

It is possible to achieve the desired level of crystal lattice dislocations at the peripheral edges of the high chloride {100} tabular grains with very low amounts of additional grain growth. Silver additions during step (2) amounting to 0.5 or less (preferably at least 1.0) percent of silver in the starting (host) grains are contemplated. Large silver additions amounting to 30 percent or more of the silver in the starting emulsion are possible, but it is preferred to limit silver addition in step (2) to 20 (optimally 10) percent or less of total silver.

The product high chloride {100} tabular grain emulsions can have mean ECD's in any conventional range. Typically mean ECD's of 5.0 $\mu$m or less are preferred. The average aspect ratios, tabular grain thicknesses, and tabular grain projected areas are within the ranges described above in connection with the starting high chloride {100} tabular grain emulsions. Halide compositions are similar to those of the starting tabular grain emulsions, except for the iodide ion incorporated in steps (a–c), rendering iodide an essential rather than an optional halide inclusion. Since silver iodide is much less soluble than other silver halides, all of the iodide ion created in step (b) is incorporated into the grains.

Emulsion sensitivity increases occur progressively as the proportion of the high chloride {100} tabular grains having 10 or peripheral crystal lattice dislocations increases. In the product emulsions greater than 10 (preferably greater than 40 and optimally greater than 90) percent of the high chloride tabular grains having {100} major faces exhibit in the iodide containing peripheral region of the grains grown in step (2) 10 or more crystal lattice dislocations extending inwardly from the peripheral edges.

After a dislocation forms, it is propagated in subsequent crystal growth. Thus, all of the dislocations originating from crystal defects produced by steps (a–c) extend to the peripheral edge of the tabular grains. In high bromide {111} tabular grain emulsions, as reported by Black et al, cited above, crystal lattice dislocations have been observed both in central regions and peripheral regions of the tabular grains, with only the latter contributing to increased levels of sensitivity.

Once formed, the high chloride {100} tabular grain emulsions can be sensitized, combined with conventional photographic addenda, and coated in any conventional manner, as is further illustrated by the starting emulsion patents cited and incorporated by reference above.

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure,* Vol. 389, September 1996, Item 38957, illustrate conventional photographic features compatible with the emulsions of the invention:

| | |
|---|---|
| I. | Emulsion grains and their preparation |
| | E. Blends, layers and performance categories |
| II. | Vehicles, vehicle extenders, vehicle-like addenda and vehicle related addenda |
| III. | Emulsion washing |
| IV. | Chemical sensitization |
| V. | Spectral sensitization and desensitization |
| VII. | Antifoggants and stabilizers |
| IX. | Coating physical property modifying addenda |
| X. | Dye image formers and modifiers |
| XI. | Layer arrangements |
| XV. | Supports |
| XVIII. | Chemical development systems |

EXAMPLES

The invention can be better appreciated by reference to the following specific examples.

Host Emulsions

Two high chloride {100} tabular grain emulsions were used as host grain emulsions for the practice of the process of the invention. These emulsions were prepared using the procedure of Chang et al U.S. Pat. No. 5,413,904. The emulsions contained 0.04 mole % iodide, based on silver.

Emulsion HC-1 exhibited a mean grain ECD of 3.5 $\mu$m and a mean tabular grain thickness of 0.18 $\mu$m. The tabular grain projected area was 93% of the total grain projected area.

Emulsion HC-2 exhibited a mean grain ECD of 2.7 $\mu$m and a mean tabular grain thickness of 0.13 $\mu$m. The tabular grain projected area was 84% of the total grain projected area.

Emulsion 1 (Example)

1.0 mole % 2-Iodoethanol (based on total Ag) Used as Slow-Release Iodide Agent

A vigorously stirred reaction vessel containing 0.20 mole Emulsion HC-2 and distilled water to 400 g at 40° C. was adjusted to a vAg of 143.7 mV (pCl of 1.71) and pH of 7.0. Then 2.2 mmole of 2-iodoethanol dissolved in 4 mL of distilled water was poured into the emulsion. Then the pH was adjusted with NaOH solution to 10.0 taking 4 min to go from pH 9.0 to 10.0 and held at 10.0 for 10 min. (The vAg dropped to 137.2 mV, which is equivalent to an increase in chloride ion of 2.18 millimole, approximately the amount of 2-iodoethanol added.) The pH was then lowered to 6.0 with $HNO_3$ followed by an increase in temperature to 70° C. After a 1 min hold at 70° C., pH 6.0, a 1M $AgNO_3$ solution was added at 1.0 mL per min and a 1.08M NaCl solution was added at a rate needed to maintain the vAg at 175 mV until 0.020 mole of silver had been added.

The resulting high chloride {100} tabular grain emulsion contained tabular grains having {100} major faces, a mean grain ECD of 2.8 μm, and a mean tabular grain thickness of 0.14 μm. The tabular grain projected area was 84% of total grain projected area.

Analysis of the emulsion tabular grains by transmission electron microscopy revealed that the tabular grains exhibited many dislocation lines at corner and edge regions of the grains. The results are summarized in Table I.

Analysis by analytical electron microscopy showed that the iodide content was 3 to 7 mole % in the corner and edge regions and was below the detection limit of the microscope (less than 0.5 mole %) in the central region of the grains.

A typical grain is shown in FIG. 1.

Example 2 (Comparison)

1.0 mole % KI Solution (based on total Ag) Used as Iodide Source

This emulsion was prepared similarly to that of Example 1, except that instead of adding the 2-iodoethanol and then increasing the pH to 10.0, 10 mL of an aqueous solution containing 2.2 mmole of KI was added at 1.0 mL per min with good mixing followed by a 10 min hold at 40° C. and pH 7.0 prior to the lowering of the pH to 6.0.

The resulting high chloride {100} tabular grain emulsion contained tabular grains having {100} major faces, a mean grain ECD of 2.8 μm, and a mean tabular grain thickness of 0.14 μm. The tabular grain projected area was 84% of total grain projected area.

The results of the transmission electron microscopy analysis of the emulsion tabular grains for dislocations are summarized in Table I.

Example 3 (Example)

0.5 mole % 2-Iodoethanol Used as Slow Iodide Release Agent

This emulsion was prepared similarly to that of Example 1, except that 1.1 mmole of 2-iodoethanol dissolved in 4 mL of distilled water was used. From the change in measured vAg at 40° C., it was determined that 1.10 millimole of chloride ion had been released by the addition of 2-iodoethanol.

The resulting high chloride {100} tabular grain emulsion contained tabular grains having {100} major faces, having a mean grain ECD of 2.8 μm, a mean tabular grain thickness of 0.14 μm. Tabular grain projected area was 84% of total grain projected area.

The results of the transmission electron microscopy analysis of the emulsion tabular grains for dislocations are summarized in Table I.

Example 4 (Comparison)

High Chloride Grains With 9 mole % Shell Produced by the Homogeneous Addition of 7 mole % Iodide. Total Overall Iodide 0.68 mole %.

To a vigorously stirred reaction vessel containing 0.2 mole Emulsion HC-1 and distilled water to 400 g at 60° C., vAg of 165 mV (pCl=1.89), and pH of 5.7 were added 1.0M $AgNO_3$ solution at 1.0 mL per min, 0.787M KI solution at 0.89 mL per min, and a 1.0M NaCl solution at a rate needed to maintain the vAg of 165 mV until 20 mmole of silver and 1.4 mmole of iodide were added.

The resulting high chloride {100} tabular grain emulsion contained tabular grains having {100} major faces, a mean grain ECD of 3.7 μm, and a mean tabular grain thickness of 0.18 μm. Tabular grain projected area was 93% of total grain projected area.

The results of the transmission electron microscopy analysis of the emulsion tabular grains for dislocations are summarized in Table I.

Example 5 (Comparison)

Emulsion E of U.S. Pat. No. 5,314,798, AgICl {100} Tabular Grain Emulsion Having Iodide Containing Shell Made Using 1.1 mole % KI A 1.5 L solution containing 3.52% by weight of low methionine gelatin, 0.0056M sodium chloride and 0.3 mL of polyethylene glycol antifoamant was provided in a stirred reaction vessel at 40° C. While the solution was vigorously stirred, 45 mL of a 0.01M potassium iodide solution were added. This was followed by the addition of 50 mL of 1.25M silver nitrate and 50 mL of a 1.25M sodium chloride solution added simultaneously at a rate of 100 mL per min each. The mixture was then held for 10 sec with the temperature remaining at 40° C. Following the hold, a 0.625M silver nitrate solution containing 0.08 mg mercuric chloride per mole of silver nitrate and a 0.625M sodium chloride solution were added simultaneously each at 10 mL per min for 30 min followed by a linear acceleration from 10 mL per min to 15 mL per min over 125 min. The pCl was adjusted to 1.6 by running the 1.25M sodium chloride solution at 20 mL per min for 8 min. This was followed by a 10 min hold then the addition of the 1.25M silver nitrate solution at 5 mL per min for 30 min. This was followed by the addition of 32 mL of 0.5M potassium iodide and a 20 min hold. Following the hold, the 0.625M silver nitrate and the 0.625M sodium chloride solution were added simultaneously each at 15 mL per min for 10 min. The pCl was then adjusted to 1.6. Then 50 g of phthalated gelatin were added, and the emulsion was washed and concentrated using the procedures of Yutzy et. al. U.S. Pat. No. 2,614,918.

The resulting high chloride {100} tabular grain emulsion contained tabular grains having {100} major faces, a mean grain ECD of 1.8 μm, and a mean tabular grain thickness of 0.13 μm. Tabular grain projected area was 75% of total grain projected area.

The results of the transmission electron microscopy analysis of the emulsion tabular grains for dislocations are summarized in Table I.

TABLE I

Peripheral Dislocations of High Chloride {100} Tabular Grain Emulsions Determined by Transmission Electron Microscopy

| Example or (Comparison) | Iodide source | % Tabular grains with 10 or more peripheral dislocations |
|---|---|---|
| 1 | R-I | 100% |
| (2) | KI | 0% |
| 3 | R-I | 100% |
| (4) | KI | 0% |
| (5) | KI | 0% |

The invention has been described in detail with particular reference to preferred embodiments thereof, but it will be understood that variations and modifications can be effected within the spirit and scope of the invention.

What is claimed is:

1. A process of preparing a product tabular grain emulsion containing product tabular grains formed by lateral growth at peripheral edges of host tabular grains, the process being comprised of the steps of (1) providing an emulsion comprised of a dispersing medium and radiation-sensitive silver halide host grains in which (i) the radiation-sensitive silver halide host grains contain greater than 50 mole percent chloride, based on silver, and (ii) greater than 50 percent of host grain projected area is accounted for by tabular grains having parallel {100} major faces, and (2) extending lateral growth of the {100} major faces of the host tabular grains by precipitating additional silver halide containing greater than 50 percent chloride, based on silver, to form product tabular grains with {100} major faces extending to peripheral edges of the product tabular grains, WHEREIN, following step (1), an iodide ion source compound R—I, in which R is an organic moiety providing a carbon to iodide bond, and an iodide release controlling compound are provided in the dispersing medium to release iodide ions at a maximum second order rate constant of less than $1\times10^3$ $mole^{-1}$ $second^{-1}$ for incorporation into the host tabular grains at their peripheral edges by chloride ion displacement, to create in the product tabular grains created by lateral growth in step (2) 10 or more crystal lattice dislocations extending inwardly from the peripheral edges of greater than 10 percent of the product tabular grains having {100} major faces.

2. A process according to claim 1 wherein the organic moiety contains up to 10 carbon atoms and includes at least one polar substituent.

3. A process according to claim 1 wherein said iodide ion release controlling compound is introduced into the dispersing medium to provide a maximum second order rate constant within the range of from $5\times10^{-3}$ to less than $1\times10^3$ $mole^{-1}$ $sec^{-1}$.

4. A process according to claim 1 wherein hydroxide ion is introduced into the dispersing medium to increase the maximum second order reaction rate constant above $5\times10^{-3}$ $mole^{-1}$ $sec^{-1}$.

5. A process according to claim 1 wherein sulfite ion is introduced into the dispersing medium to increase the maximum second order reaction rate constant above $5\times10^{-3}$ $mole^{-1}$ $sec^{-1}$.

6. A process according to claim 1 wherein the host grains account for greater than 70 percent of total grain projected area.

7. A process according to claim 6 wherein the host grains contain greater than 90 mole percent chloride, based on silver.

8. A process according to claim 1 wherein the 10 or more crystal lattice dislocations extend inwardly from the peripheral edges of more than 40 percent of the tabular grains having {100} major faces.

9. A process according to claim 8 wherein the 10 or more crystal lattice dislocations extend inwardly from the peripheral edges of more than 90 percent of the tabular grains having {100} major faces.

10. A process according to claim 1 wherein greater than 0.1 mole percent iodide is added, based on silver added in step (1).

11. A process according to claim 10 wherein from 0.2 to 5 mole percent iodide is added based on silver added in step (1).

* * * * *